US005241322A

United States Patent [19]

Gegan

[11] Patent Number: 5,241,322

[45] Date of Patent: Aug. 31, 1993

[54] TWIN ELEMENT COPLANAR, U-SLOT, MICROSTRIP ANTENNA

[76] Inventor: Michael J. Gegan, 1040 Sonoma Ave., Menlo Park, Calif. 94025

[21] Appl. No.: 902,485

[22] Filed: Jun. 23, 1992

Related U.S. Application Data

[63] Continuation of Ser. No. 673,698, Mar. 21, 1991, abandoned.

[51] Int. Cl.[5] ..... H01Q 1/38

[52] U.S. Cl. ..... 343/700 MS; 343/767

[58] Field of Search ..... 343/700 MS, 767, 829, 343/831, 846, 847, 830, 769, 770, 771, 725

[56] References Cited

U.S. PATENT DOCUMENTS

| | | | |
|---|---|---|---|
| 4,464,663 | 8/1984 | Lalezari et al. | 343/700 MS |
| 4,686,535 | 8/1987 | Lalezari | 343/700 MS |
| 4,692,769 | 9/1987 | Gegan | 343/700 MS |
| 4,766,440 | 8/1988 | Gegan | 343/700 MS |

*Primary Examiner*—Donald T. Hajec
*Assistant Examiner*—Hoanganh Le
*Attorney, Agent, or Firm*—Kenneth L. Warsh

[57] ABSTRACT

A microstrip antenna employing twin radiating elements is interconnected in a configuration that achieves two frequencies of circular polarization. This configuration also provides parasitic resonance suppression. The twin radiating element configuration permits incorporation of the twin element antenna into a multi-element antenna array.

1 Claim, 4 Drawing Sheets

TWIN ELEMENT COPLANAR, U-SLOT, MICROSTRIP ANTENNA

This application is a continuation, of application Ser. No. 07/673,698, filed Mar. 21, 1991, now abandoned.

FIELD OF THE INVENTION

This invention relates in general to low physical profile antennas, and in particular, to a twin element coplanar microstrip antenna having circularly polarized frequencies of operation that can be readily incorporated into a multi-element array.

BACKGROUND OF THE INVENTION

Previous single feed point, dual frequency, circularly polarized, microstrip antenna designs required 2 microstrip feed networks for antenna arrays. Each feed network would be connected to a set of single frequency, circularly polarized, microstrip elements. The feed networks would be positioned back-to-back to achieve a single feedpoint design. The dual feed network approach described requires a diplexer at the common feedpoint to prevent detuning of one feed network by the other feed network. Typically, the diplexer will add approximately 0.5 dB loss to a dual band, circularly polarized, antenna system at L Band. The dual feed network approach requires space for the diplexer and enough clearance between the diplexer and adjacent feed network lines to prevent excessive coupling between the diplexer and adjacent feed networks. Excessive coupling between the diplexer and feed networks would result in a detuned diplexer and higher loss feed networks.

U.S. Pat. No. 4,692,769 to the same inventor, entitled Dual Band Slotted Microstrip Antenna, disclosed instantaneous dual band operation in a slotted microstrip radiating element. The two resonances are perpendicularly polarized and may be separated by as much as a 2:1 ratio.

U.S. Pat. No. 4,766,440 to the same inventor, entitled Triple Frequency U-Slot Microstrip Antenna, discloses an antenna with either triple frequency operation or dual frequency operation in which one frequency is circularly polarized and the other frequency is elliptically polarized.

The subject invention, in contrast, is a circularly polarized twin element design that interconnects two pairs of antenna elements in a configuration that suppresses parasitic resonances and permits incorporation into a closely spaced linear array. Any circularly polarized microstrip element can be used in this twin element configuration.

OBJECTIVES OF THE INVENTION

It is therefore a primary objective of the present invention to provide a 2 element, in-phase, dual band, circularly polarized antenna array having a single feedline and no diplexers.

Another objective of the invention is to provide a twin element antenna that can be incorporated into a linear multi-element array with a minimum element to element centerline spacing of 0.4 free space wavelength and a minimum element width of 0.5 substrate wavelength, for efficient, uniform antenna pattern performance in a circularly polarized array.

SUMMARY OF THE INVENTION

These objects of the invention and other objects, features and advantages to become apparent as the specification progresses are accomplished by the invention according to which, briefly stated, the antenna array has 2 circularly polarized channels of operation. This dual frequency, circularly polarized, antenna array can be incorporated into a larger array by using a single input port, multiple-output port, microstrip feed network.

LIST OF ADVANTAGES OF THE INVENTION

An important advantage of the present invention is that it provides a dual band, circularly polarized, antenna array that contains one feed network with no diplexers. The prior antenna method requires two feed networks and a diplexer at the common feedpoint. For an in-phase antenna array of many elements, this invention provides significant space savings since only one feed network is needed. The absence of diplexers in this invention implies a simpler, more efficient, antenna system.

A further advantage is that this dual band, circularly polarized, twin element design can be etched on one side of a copper clad substrate using standard printed circuit techniques. The type of microstrip antenna element in a twin element array can be selected to achieve a desired beamshape, bandwidth, or surface area.

These and further objectives, constructional and operational characteristics, and advantages of the invention will no doubt be more evident to those skilled in the art from the detailed description given hereinafter with reference to the figures of the accompanying drawings, which illustrate a preferred embodiment by way of non-limiting example.

GLOSSARY

The following is a glossary of elements and structural members as referenced and employed in the present invention.

10,12—a first pair of antenna elements
14,16—a second pair of antenna elements
18,20—divider lines
22,24,26,28—feedlines
30—feedpoint
32—82 ohm chip resistor
34—SMA connector pin

DESCRIPTION OF THE PREFERRED EMBODIMENTS

Figure 1:
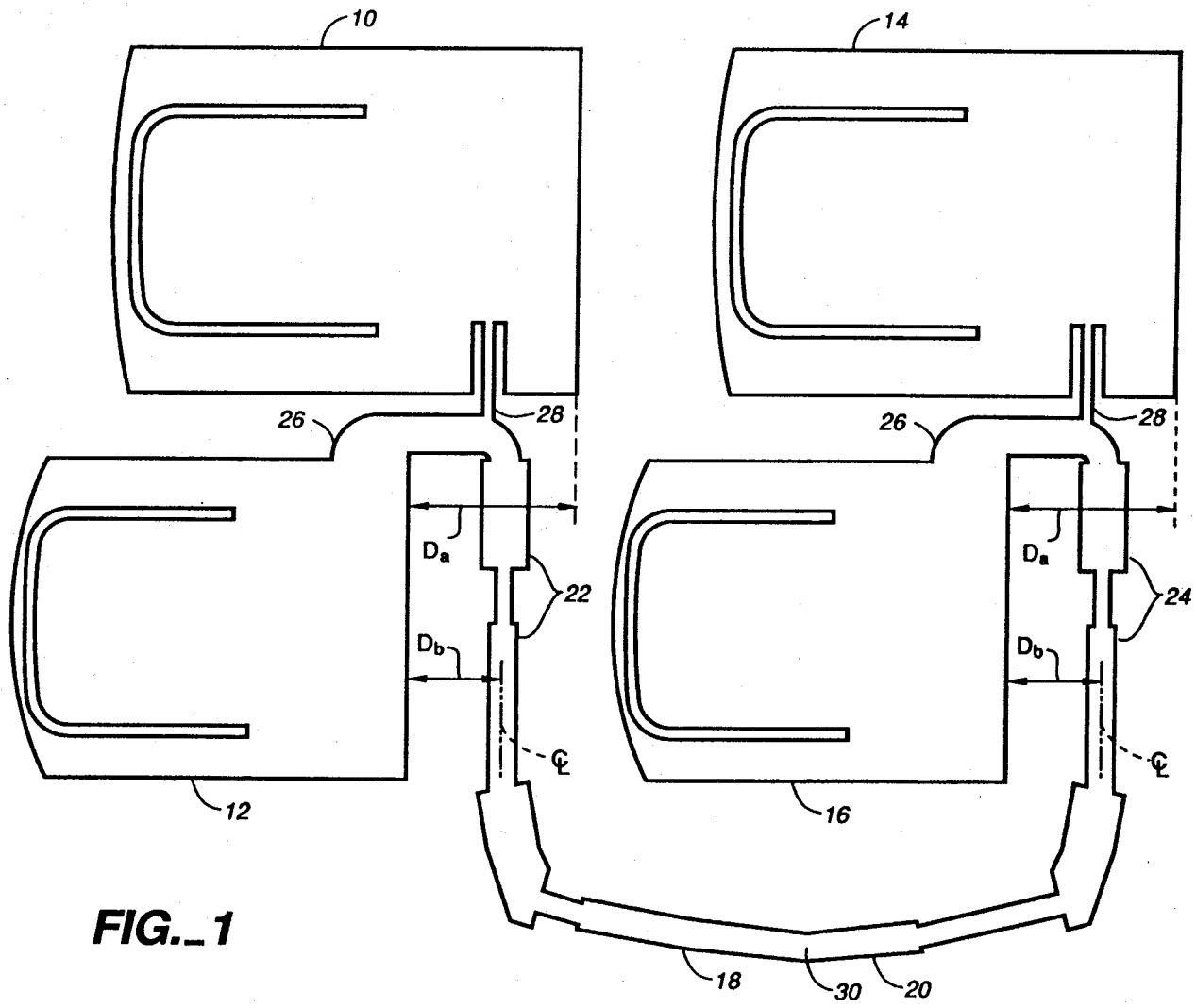
FIG. 1 shows a plan view of the microstrip antenna according to the invention.

Referring now to the drawings wherein like reference numerals are used to designate like or corresponding parts throughout the various figures thereof, there is shown in FIG. 1 a plan view of the microstrip antenna according to the invention. The invention consists of 2 pairs of microstrip antenna elements made of copper. Each pair 10, 12 and 14, 16 is fed in shunt to provide 2 circularly polarized frequencies of operation, $F_{01}$ and $F_{02}$. Elements 10 and 14 have a maximum gain frequency, $F_1$, and elements 12 and 16 have a maximum gain frequency, $F_2$. The feedline and element locations are determined by consideration of undesired parasitic resonance suppression. $F_{01}$ is made lower than $F_{02}$ to achieve minimum coupling between the 2 way divider lines 18 and 20 and the lower antenna elements 12 and 16. Twin element coupling between elements 10 and 12 and between elements 14 and 16, coupling between elements 10 and 14, and coupling between elements 12 and 16 and their respective feedlines 22 and 24 cause an undesired parasitic resonance.

The frequency $F_p$ of this parasitic resonance can occur within the range $$0.97\ F_1 \leqq F_p \leqq 1.07\ F_1. \quad (1)$$

The parasitic resonance causes the least degradation of the desired resonance $F_1$ when $$F_p = 0.98\ F_1. \quad (2)$$

$F_p$ is a function of the element resonance $F_1$, coupling capacitance between elements 10 and 14, twin element coupling capacitance, and to a lesser extent, the coupling capacitance between elements 12 and 16 and their respective feedlines 22 and 24. These coupling capacitances, elements 10 and 14, and the microstrip feedline between elements 10 and 14 form a circuit that possesses a parasitic resonance, $F_p$, as well as a detuned resonance $F_1$. In this circuit, the element resonance $F_1$ is the dominant component. The parasitic resonance $F_p$, essentially "tracks" the element resonance, $F_1$. As $F_1$ is varied (by altering the dimensions of elements 10 and 14, $F_p$ follows $F_1$. The amount of offset, $F_1$—$F_p$, can be controlled by changing the twin element coupling capacitance. This control can be used to set the parasitic resonance, $F_p$, at 0.98 $F_1$. Dimension $D_a$ has a direct effect on the twin element coupling capacitance. By constraining $D_a$ within the limits $$(0.17)\ \lambda_1 \leqq D_a \leqq (0.20)\ \lambda_1 \quad (3)$$

where $\lambda_1$ = wavelength in substrate at $F_1$, the twin element coupling capacitance will "pull" the offset such that $F_p = 0.98\ F_1$.

The coupling capacitance between elements 12 and 16 and their respective feedlines 22 and 24 (controlled by dimension $D_b$) has a lesser effect on the parasitic resonance, $F_p$, as compared to the effect of the twin elements coupling capacitance. The coupling capacitance between element 12 and 16 and their respective feedlines 22 and 24 has little effect on the frequency of the parasitic resonance, $F_p$. If $F_p$ is set at 0.98 $F_1$, the degradation to $F_1$ caused by the parasitic resonance, $F_p$ can be minimized by constraining $D_b$ such that $$0.086\ \lambda_1 \leqq D_b \leqq 0.121\ \lambda_1 \quad (4)$$

where $\lambda_1$ = wavelength in substrate at $F_1$.

A further constraint is defined $$1.06\ F_1 \leqq F_2 \leqq 1.24\ F_1. \quad (5)$$

for a substrate thickness of 0.015 $\lambda_1$. This constraint reflects the minimum and maximum separation between $F_1$ and $F_2$ that is needed to prevent a) excessive detuning of elements 10 and 14 by elements 12 and 16 at frequency $F_1$ and b) excessive detuning of elements 12 and 16 by elements 10 and 14 at frequency $F_2$. If $F_1$ and $F_2$ are not constrained by the limits defined in equation (5), the impedance matching required to compensate for excessive detuning of elements 10 through 16 will imply a very low microstrip characteristic impedance for feedline 26 and a very high microstrip characteristic impedance for feedline 28. These very low and very high characteristic impedances are not feasible due to feedline loss and space constraints.

The degradation caused by the parasitic resonance $F_p$ to the desired resonance, $F_1$, occurs on the "high side roll-off" at approximately 1.04 $F_1$. As an example, the gain versus frequency profile at 1.4 GHz normally has a slope of approximately 0.05 dB/MHz for a substrate thickness of 0.015 $\lambda_1$ at 0.96 $F_1$ and at 1.04 $F_1$. The gain roll-off at 1.04 $F_1$ degrades to a steeper slope when the parasitic resonance, $F_p$ is present. The minimum degradation due to the parasitic resonance, $F_p$, to the gain roll-off at 1.04 $F_1$ is approximately 0.2 dB/MHz. In general, this condition exists when $D_a$ and $D_b$ are within the limits defined by equations (3) and (4). If $F_1$ is shifted such that $$F_1 = 1.008\ F_{01} \quad (6)$$

for a substrate thickness of 0.015 $\lambda_1$, the asymmetrical gain versus frequency profile will yield 1 dB points that are symmetrical relative to $F_{01}$.

The 1 dB points for channel $F_{01}$ exhibit a 3.2 percent bandwidth. The 2.0:1 VSWR bandwidth for channel $F_{01}$ is 3.7 percent. The 1 dB points for channel $F_{02}$ are symmetric relative to $F_2$ and exhibit a bandwidth of 2.9 percent. The 2:1 VSWR bandwidth for channel $F_{02}$ is 3.3 percent.

Figure 2:
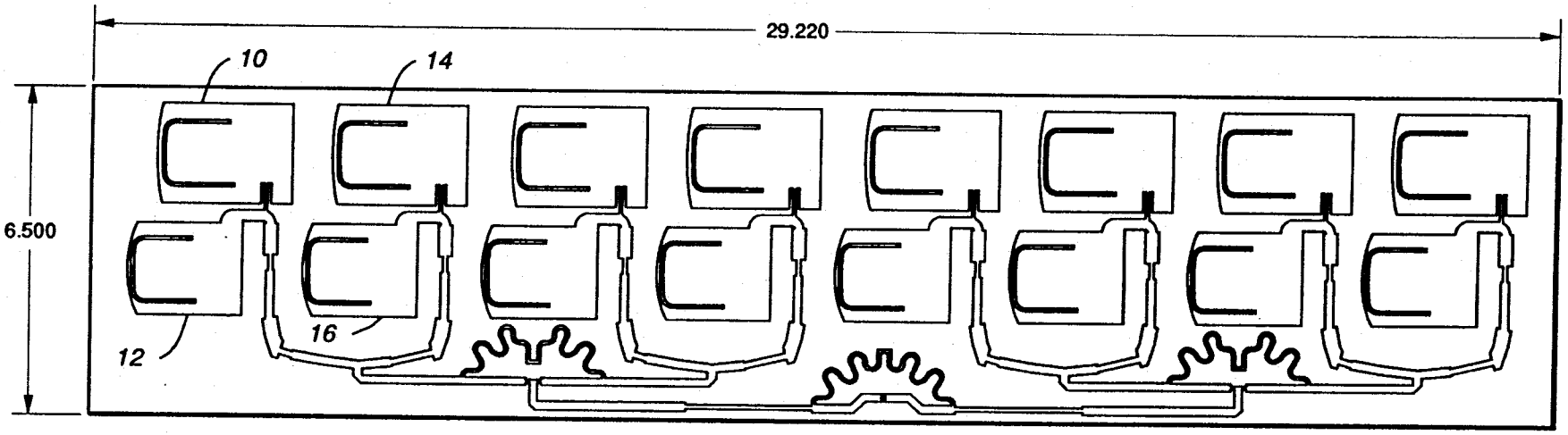
FIG. 2 shows an example of a twin element configuration that is used in an 8 element, in-phase, dual band, circularly polarized antenna array.
Figure 3:
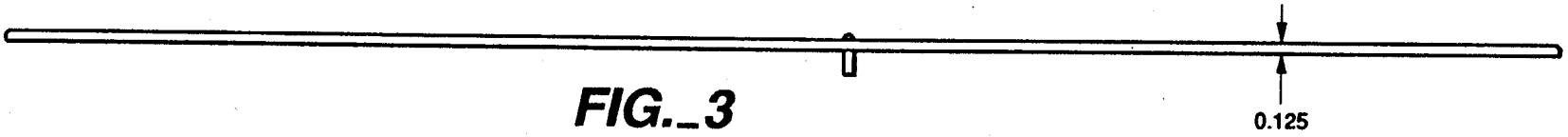
FIG. 3 is an edge view of the configuration of FIG. 2.
Figure 4:
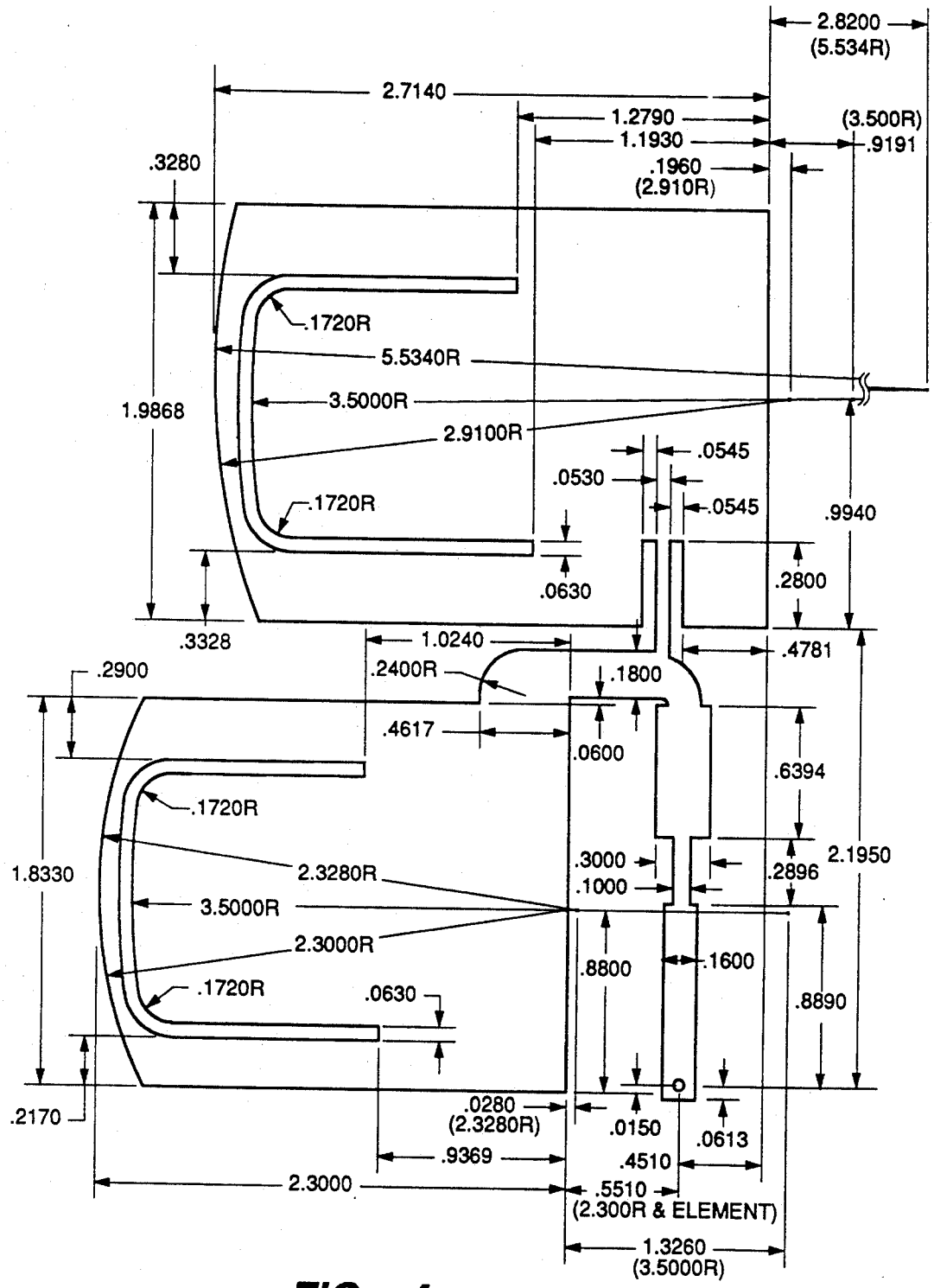
FIGS. 4, 5, 6 show the dimensions in inches of the preferred embodiment of the array of FIG. 2.
Figure 5:
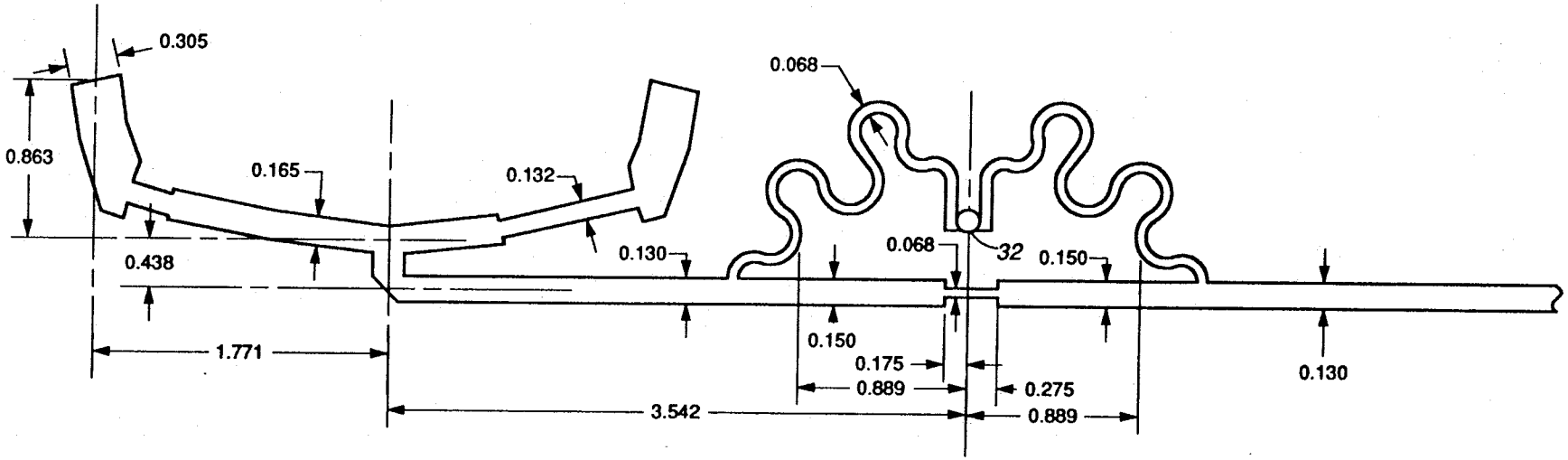
Figure 6:
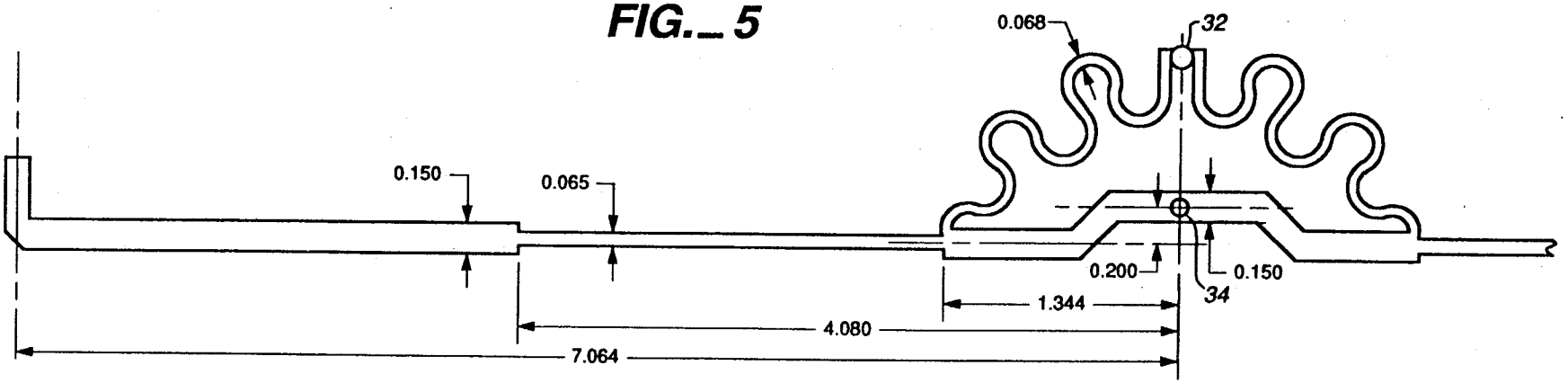

The invention, as shown in FIG. 2, can be used in a larger, in-phase, circularly polarized, antenna array which operates at $F_{01}$ and $F_{02}$. In this example, $F_{01}$ is 1.381 GHz and $F_{02}$ is 1.575 GHz and the substrate is teflon/fiberglass with a dielectric constant of 2.55. The width of the 16 element array shown in FIG. 2 is 0.76 $\lambda_1$ (free space). The use of U-slot microstrip antenna elements results in a more compact (less wide) antenna array than would be the case with square microstrip elements. An antenna array has been constructed in accordance with the dimensions shown in FIGS. 4, 5 and 6.

For the specific application shown in FIG. 2, a dual feed network approach with U-slot elements would occupy approximately 8.4" width, exclusive of diplexer. The twin element approach occupies a 6.5" width. Thus, the twin element approach, for the application shown in FIG. 2, offers at least a 23 percent reduction in width as compared to the dual feed network approach.

In the application shown in FIG. 2, a U-slot microstrip element is used to achieve a small array width. If twin square microstrip elements are used, this array will have a 7.5" width, an increase of 15 percent compared to the twin U-slot design. If a dual feed network, square element configuration is used, this array will have a 9.3" width, exclusive of diplexer, an increase of 43 percent compared to the twin U-slot design.

This invention is not limited to the preferred embodiment and alternatives heretofore described, to which variations and improvements may be made, without departing from the scope of protection of the present patent and true spirit of the invention, the characteristics of which are summarized in the following claims.

What is claimed is:

1. A microstrip antenna having a frequency of maximum gain $F_1$, comprising:

a thin dielectric substrate in which $F_1$ has wavelength $\lambda_1$;

a thin conductive layer disposed on one surface of said substrate, said conduction layer forming a ground plane;

first and second thin conductive radiating elements disposed on the other side of said substrate, said first and second radiating elements each having left, right, front and rear edges, said first and second radiating elements having first and second feedlines, respectively, said first radiating element having said first feedline attached on said right edge and said second radiating element having said second feedline attached on said left edge, said front edge of said second radiating element being offset from said front edge of said first radiating element by a critical spacing $D_a$, said second feedline of said second radiating element have a section which parallels said front edge of said second radiating element at a critical distance $D_b$, interconnecting means for connecting said first and second feedlines, said feedlines and interconnecting means providing means for suppressing parasitic resonances governed by critical spacing $$(0.17)\lambda_1 < D_a < (0.20)\lambda_1 \text{ and } (0.086)\lambda_1 < D_b < (0.121)\lambda_1.$$

* * * * *